United States Patent [19]

Vincent

[11] Patent Number: 4,676,788

[45] Date of Patent: Jun. 30, 1987

[54] GUIDE MEMBER FOR A VIAL

[75] Inventor: Laurent Vincent, Dunstable, Mass.

[73] Assignee: E. I. Du Pont de Nemours and Company, Wilmington, Del.

[21] Appl. No.: 802,302

[22] Filed: Nov. 27, 1985

[51] Int. Cl.[4] ..... A61J 19/02

[52] U.S. Cl. ..... 604/415

[58] Field of Search ..... 604/116, 174, 415

[56] References Cited

U.S. PATENT DOCUMENTS

| | | | |
|---|---|---|---|
| 2,415,871 | 2/1947 | Woody | 604/415 |
| 2,644,452 | 7/1953 | Brown | 604/415 |
| 3,336,924 | 8/1967 | Sarnoff et al. | 604/415 |
| 3,920,001 | 11/1975 | Edwards | 604/116 |

FOREIGN PATENT DOCUMENTS

| | | | |
|---|---|---|---|
| 2340179 | 2/1975 | Fed. Rep. of Germany | 604/174 |
| 1155543 | 5/1958 | France | 604/415 |
| 0464546 | 4/1937 | United Kingdom | 604/415 |

*Primary Examiner*—C. Fred Rosenbaum
*Assistant Examiner*—Sherri Vinyard

[57] ABSTRACT

A guide member is adapted to be removably mounted in the access aperture of a capped vial and arranged to guide and to support a delicate syringe needle as the same is advanced through a resilient septum closing the vial.

2 Claims, 2 Drawing Figures

GUIDE MEMBER FOR A VIAL

BACKGROUND OF THE INVENTION

1. Field of the Invention

The present invention relates to a guide member for supporting a hypodermic needle while the same punctures the septum of a vial useful to carry a radioactive substance.

2. Description of the Prior Art

When using a delicate "Hamilton"-type syringe needle to puncture the rubber septum overlying a vial to extract a liquid contained therein, extreme care must be exercised to guard against the possibility of the needle bending or breaking. In addition to the extraction needle, it is often the practice to insert additionally through the septum a vent or filter needle connected to a charcoal filter to remove any noxious gas collecting within the vial. This additional needle must be located with respect to the septum to perform its desired function and yet must not interfere with the ingress and egress of the extraction needle.

In view of the foregoing it is believed to be advantageous to provide an arrangement whereby a delicate needle, such as a "Hamilton"-type syringe needle, is guided and supported as it punctures the resilient rubber septum provided over the mouth of a vial. Further, it is believed advantageous to provide a further guide arrangement to guide a vent needle to a location spaced from the point of entry of the extraction needle.

SUMMARY OF THE INVENTION

The present invention relates to a needle guide member adapted to provide guided support for a delicate needle as the same is directed toward and punctures a resilient septum. The septum is usually, but not necessarily, carried in the cap which is threadedly connectable to the vial. The guide member in accordance with the present invention may exhibit any predetermined external configuration but, in whatever form, it is provided with a projecting boss configured and sized for close-fitting receipt into the access aperture in the cap of the vial. The guide member has a first guide passage provided therein sized to accept a syringe needle in a close-fitting supporting relationship. When the guide member is so positioned, the first guide passage is in fluid communication with an exposed surface of the septum. A delicate extraction needle, such as a "Hamilton"-type syringe needle, may be introduced into the guide passage and advanced in a supported relationship through a first predetermined point in the septum such that bending or breaking of the needle is thereby advantageously avoided. The guide member is further provided with an additional guide passage which accepts a second needle such as a filter needle or a vent needle, and guides the same to an entry point on the septum spaced from the predetermined point of entry of the extraction needle.

BRIEF DESCRIPTION OF THE DRAWING

The invention may be more fully understood from the following detailed description taken in connection with the accompanying drawings which form a part of this application and in which.

DETAILED DISCLOSURE OF THE INVENTION

Figure 2:
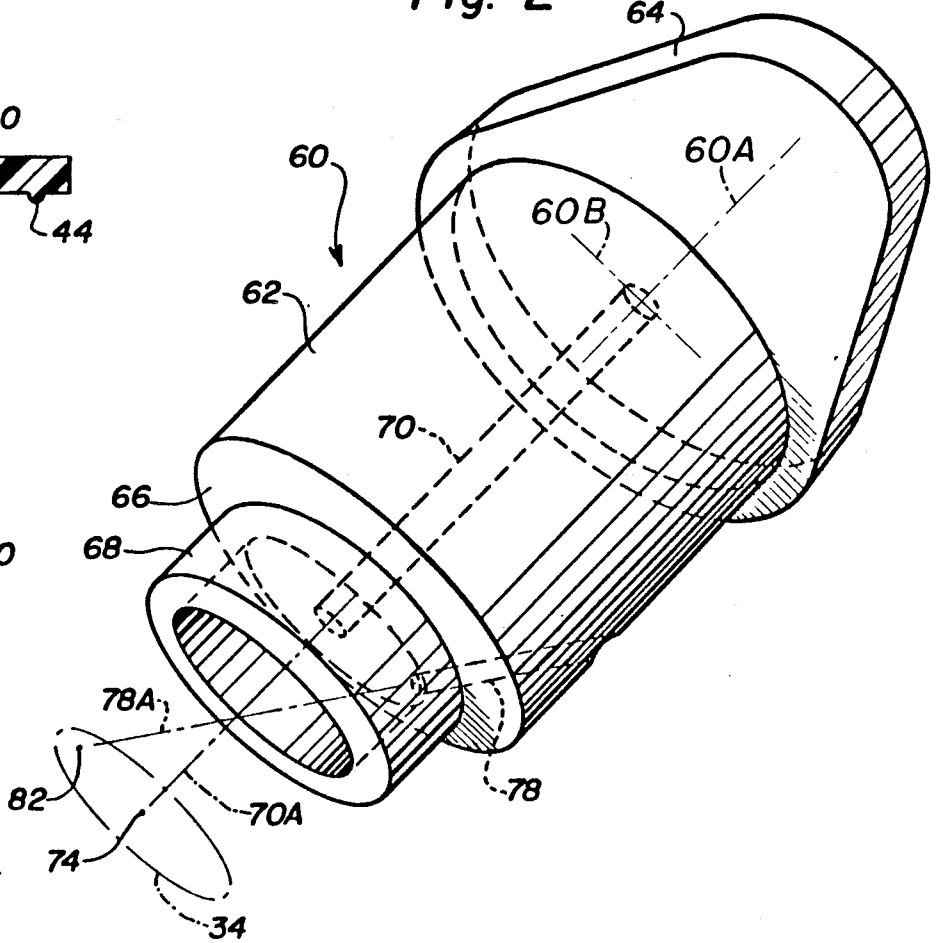
FIG. 2 is a perspective view of the needle guide member shown in section in FIG. 1 in accordance with the present invention.

Throughout the following detailed description similar reference characters refer to similar elements in all Figures of the drawings.

A vial generally indicated by reference character 10 has a main body portion 12. A reduced dimensioned collar 14 is integrally formed atop the body portion 12. Projecting upwardly from the collar 14 is a neck 16. The neck 16 has external threads 18 carried thereon. A recess 20 opens at the neck 16 and extends centrally and axially through the vial 10. A cone-shaped glass vessel 22 is inserted into the recess 20. The vessel 22 carries a radioactive liquid, such as a solution of the radionuclide iodine-125.

The main body portion 12 of the vial 10 is substantially square in external configuration although the body portion 12 may assume any desired configuration. The sidewalls of the main body portion 12 may be dimpled, as at 24, to facilitate manipulation by an operator. The base of the body portion 12 is planar and easily supported by a planar support surface S. The vial 10, although relatively diminutive in size, is large enough to prevent tipping.

The vial 10 is molded from a suitable plastic material, such as an ionomer resin material sold by E. I. du Pont de Nemours and Company, Inc. under the trademark SURLYN®. Type 8920 of this material is preferred.

Access to the upper end of the recess 20 and to the vessel 22 is closed by a cap 28 having internal threads 30 thereon. Threaded engagement of the internal threads 30 of the cap 28 and the external threads 18 on the neck 16 of the vial 10 advances the cap 28 toward the vial.

The cap 28 includes a resilient rubberized septum 34 fabricated of any self-healing elastomeric material lined with a thin film (e.g., ten mm) such as a fluoro carbon film sold by E. I. du Pont de Nemours and Company, Inc., under the trademark TEFLON®. The septum 34 is press fit in a recess 36 provided on the interior of the cap 28 such that when the cap 28 is threaded onto the vial 10 the septum 34 is disposed as a member over the open mouth of the recess 20 and the vessel 22 to provide a fluid tight seal to maintain the liquid within the vial 10.

Figure 1:
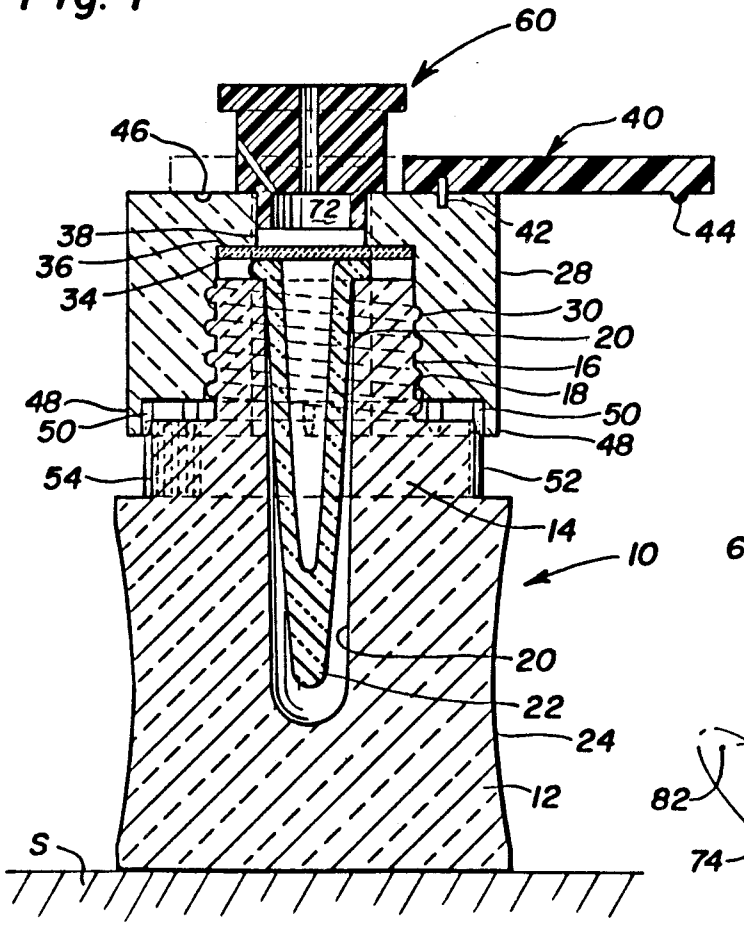
FIG. 1 is a side elevational view entirely in section of a needle guide member in accordance with the present invention mounted in its operative position with respect to a recessed vial.

The cap 28 further includes an access aperture 38 which communicates with a portion of the septum 34. The access aperture 38 may take any convenient configuration. A pivotably movable access cover 40 is provided on the cap 28 to close the access aperture 38. The cover 40 is pivotable on a post 42 received in the cap 28. The cover 40 carries a detent 44 which is received in a depression 46 provided in the cap 28. Pivoting of the cover 40 in a plane parallel to the top of the cap 28 from the locked position shown in dotted lines in FIG. 1 to the open position shown in FIG. 1 by the solid lines exposes the portion of the septum 34 presented to the access aperture 38. The cap 28 has a downwardly depending skirt 48 formed integrally therewith. The skirt 48 carries on its interior surface a plurality of locking ribs 50. The cap 28 is molded of a plastic material, such as a acrylonitrile butadiene styrene plastic sold by Borg-Warner Inc. under the trademark CYCOLAC.

The collar 14 carries a first and a second array of locking ridges 52, 54 respectively disposed in diametric opposition on the circular collar 14. The ridge arrays 52, 54 subtend angles of approximately twenty-five degrees about the circumference of the collar 14. The ribs 50 on the cap 28 are spaced so that as the cap 28 is threaded onto the neck 16 different ones of the ribs 50 interengage each of the ridge arrays 52, 54. Preferably at least two of the ribs 50 are interengaged with the ridges when the cap is threaded. This interlocking of the ribs and ridges assists in preventing back-off of the cap 28 from the vial 10.

The guide and support member 60 in accordance with the present invention includes a main portion 62 of any predetermined exterior configuration. Preferably the main portion 62 is generally cylindrical in shape and has a flange 64 and a lower shoulder 66 thereon. The upper flange 64 is substantially elliptical in shape and facilitates the grasping of the support member 60 while the lower shoulder 66 serves as an abutment shoulder for the member 60. The major axis of the flange is indicated by reference character 60A and the minor axis is indicated by the reference character 60B. A boss 68 projects from the main portion 62. The exterior of the boss 68 is sized and configured for close-fitting receipt within the access aperture 38 in the cap 28. A first unobstructed guide passage 70 extends substantially centrally and axially of the main portion 62 although the passage may, of course, occupy any predetermined orientation within the main portion 62. In the mounted configuration shown in FIG. 1 the boss 68 projects through the access aperture 38 in the cap 28 and defines an access volume 72 (FIG. 1) between the lower end of the main portion 62 and the upper surface of the septum 34. When so positioned the first guide passage 70 in the guide member 60 is in fluid communication with the exposed portion of the septum and the axis 70A of the passage 70 intersects the septum 34 at a first predetermined entry point 74.

A second passage 78 is provided through the main portion 62 and communicates with the access volume 72. The axis 78A of the passages 78 defines a predetermined angle with respect to the axis 70A so as to intersect the septum 34 at a point 82, spaced from the entry point 74. The angle between two axes 70A, 78A is arranged so that a needle entering via the passage 78 is guided in such a manner that it would enter only slightly, if at all, into the vessel. Preferably, the extension of the axis 78A of the passage 78 extends through the septum and intersects the lip portion of the vessel 22.

In practice the support member 60 is grasped by the flange 64 and is positioned in the access aperture 38 as shown in FIG. 2 such that the lower shoulder 66 abuts the upper surface of the cap 28 surrounding the aperture 38. A "Hamilton"-type syringe or other delicate needle (such as a needle having a diameter less than 0.035 inch) may be inserted through the first guide passage 70 in the main portion 62 of the guide and support member 60. Continued axial advancement of the syringe needle through the passage 70 brings the needle into contact with the material of the septum 34 at the entry point 74. The further advance of the needle through the septum 34 and into the 22 vial 10 is supported by the support member 60. Thus, bending or breakage of the needle is minimized or avoided.

In some instances it may be necessary to first eliminate any gaseous buildup in the vial. To this end a needle connected to a suitable filter is introduced through the second passage 78 and into the recess 20 at the second entry point 82. The motion of the second needle is guided to its point of entry 82 by the passage 78 spaced from the entry point 74. For convenience, the second passage 78 is aligned with the minor axis 60B of the flange 64.

Those skilled in the art having benefit of the present invention as hereinabove set forth may effect modifications thereto. These modifications are, however, to be construed as lying within the scope of the present invention as defined by the appended claims.

What is claimed is:

1. A guide member for use with a capped vial of the type having a recess receiving a vessel therein, the vessel having a lip thereon, a resilient septum overlying the recess, the cap of the vial having an access aperture exposing a portion of the septum, the guide member comprising:

a main portion having a first, central, unobstructed guide passage therethrough sized to receive a syringe needle in a close-fitting supported relationship and guide the same to an entry point in the septum;

a downwardly depending boss projecting from the main portion of the guide member, the boss being sized and configured for receipt within the access aperture such that when positioned a clearance volume is defined between the lower end of the guide member and the upper surface of the septum;

the main portion having a second unobstructed guide passage therein communicating with the clearance volume, the axis of the second passage defining a predetermined angle in with respect of the first passage such that a second needle is guided in a close-fitting supported relationship to intersect the septum at point spaced from the entry point and to enter through the septum in the vicinity of the lip of the vessel.

2. The guide member of claim 5 further comprising a flange disposed at the upper end of the main portion, the flange having a predetermined geometric configuration having a predetermined axis thereon, the second passage being aligned with the predetermined axis of the flange.

* * * * *